US007404273B2

(12) United States Patent
Burg et al.

(10) Patent No.: US 7,404,273 B2
(45) **Date of Patent: *Jul. 29, 2008**

(54) WALL AND PARTITION CONSTRUCTION AND METHOD INCLUDING A LATERALLY ADJUSTABLE FLANGED STUD

(76) Inventors: John Parker Burg, 20990 Valley Green Dr. Apt. 703, Cupertino, CA (US) 95014; Mark Doyle, 110 Sunrise Rd., Dennison, TX (US) 75021

( * ) Notice: Subject to any disclaimer, the term of this patent is extended or adjusted under 35 U.S.C. 154(b) by 734 days.

This patent is subject to a terminal disclaimer.

(21) Appl. No.: 10/798,095

(22) Filed: Mar. 11, 2004

(65) Prior Publication Data

US 2005/0210798 A1 Sep. 29, 2005

(51) Int. Cl.
*E04B 2/30* (2006.01)

(52) U.S. Cl. ..... 52/481.1; 52/483.1; 52/783.1

(58) Field of Classification Search ..... 52/479, 52/474, 475.1, 481.1, 481.2, 483.1, 772, 52/585.1, 731.1, 281, 783.1, 300, 653.1, 52/716.6, 716.8, 731.9, 272, 747, 771, 429
See application file for complete search history.

(56) References Cited

U.S. PATENT DOCUMENTS 3,310,917 A * 3/1967 Simon ..... 52/91.1
3,755,979 A * 9/1973 Pantazi ..... 52/481.2
4,114,333 A * 9/1978 Jones et al. ..... 52/265
4,408,427 A * 10/1983 Zilch ..... 52/481.2
4,584,808 A * 4/1986 Wendt ..... 52/481.1
5,092,100 A * 3/1992 Lambert et al. ..... 52/774
5,996,299 A * 12/1999 Hsueh ..... 52/481.2
6,993,875 B2 * 2/2006 Rudduck ..... 52/474

* cited by examiner

*Primary Examiner*—Richard E. Chilcot, Jr.
*Assistant Examiner*—Jessica Laux

(57) ABSTRACT

An improved wall and partition construction method that features use of no exterior panel attachment means, and which provides a finished wall with a substantially seemless outer surface. The improved wall is comprised of ceiling and floor rails attached along a top and bottom wall line, and a plurality of vertical studs, slidably disposed between the floor and ceiling rails. Vertical slidable studs each have a hat-shaped cross section and include a plurality of openings that provide a pathway for cables and wiring along the interior of a finished wall. Wall panels such as compressed straw panels are attached to the vertical studs in a slightly offset alternating manner such that each strawboard panel can be rigidly connected to a stud by a plurality of lag screws with each penetrating the strawboard panel from the inside so that the finished wall has no exterior penetrations.

16 Claims, 16 Drawing Sheets

PRIOR ART

PRIOR ART

WALL AND PARTITION CONSTRUCTION AND METHOD INCLUDING A LATERALLY ADJUSTABLE FLANGED STUD

FEDERALLY SPONSORED RESEARCH AND DEVELOPMENT STATEMENT

This invention was not developed in conjunction with any Federally sponsored contract.

CROSS-REFERENCE TO RELATED APPLICATIONS (CLAIMING BENEFIT UNDER 35 U.S.C. 120)

This application is related to U.S. patent application, Ser. No. 10,715,258, filed on Nov. 17, 2003, by John Parker Burg.

MICROFICHE APPENDIX

Not applicable.

INCORPORATION BY REFERENCE

This application is incorporated by reference related patent application, Ser. No. 10,715,258 in its entirety.

BACKGROUND OF THE INVENTION

The fitting-out of occupiable space is continuously becoming more important and ever more challenging for those utilizing modem office buildings, business and conference centers, hotels, classrooms, medical facilities, and the like. In the competitive business environment, cost concerns alone often dictate the efficient use of interior space. Thus, the finishing or fitting-out of building spaces for offices and other areas where work is conducted has become a very important aspect of effective space planning and layout.

Business organizations, their work patterns and the technology utilized therein are constantly evolving and changing. Building space users require products that provide for change at minimal cost. At the same time, their need for functional interior accommodations remains steadfast. Issues of privacy, functionality, aesthetics, acoustics, etc., are unwavering. For architects and designers, space planning for both the short and long term is a dynamic and increasingly challenging problem. Changing work processes and the technology required demand that designs and installation be able to support and anticipate change.

Space allocation and planning challenges are largely driven by the fact that modern office spaces are becoming increasingly more complicated due to changing and increasing needs of users for more and improved utilities support at each workstation or work setting. These utilities encompass all types of resources that may be used to support or service a worker, such as communications and data used with computers and other types of data processors, telecommunications, electronic displays, etc., electrical power, conditioned water, and physical accommodations, such as lighting, HVAC, sprinklers, security, sound masking, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving complex problems. Such equipment has very stringent power and signal requirements, and must quickly and efficiently interface with related equipment at both adjacent and remote locations. Work areas with readily controllable lighting, HVAC, sound masking, and other physical support systems, are also highly desirable to maximize worker creativity and productivity. Many other types of high technology equipment and facilities are also presently being developed which will need to be accommodated in the work places of the future. Moreover, the office space layout of these "knowledge workers" changes frequently to accommodate new technology, or to accommodate changing work teams resulting from changing business objectives, changing corporate cultures, or a combination thereof.

Office workers today need flexible alternative products that provide for the obtainment of numerous, often seemingly conflicting objectives. For example, the cultural aims of an organization may require the creation of both individual and collaborative spaces, while providing a "sense of place" for the users, and providing a competitive edge for the developer. Their needs include a range of privacy options, from fully enclosed offices which support individual creative work to open spaces for collaborative team work. At the same time, their products must be able to accommodate diverse organizations, unique layout designs, and dynamic work processes.

Further compounding the challenge are the overall objectives to promote productivity, minimize the expenses of absenteeism and workforce health insurance, and reduce potential liability. Meeting these objectives often requires improved lighting, better air quality, life safety, and ergonomic task support.

As previously mentioned, the cost efficient use of building floor space is also an ever-growing concern, particularly as building costs continue to escalate. Open office plans that reduce overall office costs are commonplace, and generally incorporate large, open floor spaces. These spaces are often equipped with modular furniture systems that are readily reconfigurable to accommodate the ever-changing needs of specific users, as well as the divergent requirements of different tenants. However, for privacy, productivity, or other reasons, interior walls and/or partitions are still required although the functionality requirements of interior walls is changing.

Historically, office walls or partitions are made by erecting a wood frame comprising vertical studs spaced on a regular interval, lining each side with gypsum board (sheet rock) panels, then finishing the wall surfaces with a variety of textures and paint. When additional thermal and/or acoustic insulation is needed, insulation medium such as fiberglass, rock wool or mineral wool will commonly be placed to fill the interior space between vertical studs and gypsum board panels.

These conventional walls have proven sturdy, provide adequate privacy and sound proofing, and provide a surface that easily accepts wall hangings such as pictures, paintings, plaques and the like. Furthermore, as is commonly known, conventional walls can easily be repainted, retextured, and readily patched and repaired when damaged. Conventional gypsum board partitions are typically custom built floor-to-ceiling installations that, due primarily to the vertical studs, are time-consuming to erect and build. The increased need for utility wiring, such as power and communication cables, have made conventional vertical stud-based walls more cumbersome and inconvenient as horizontal paths for the utility wiring must be routed either through numerous vertical studs or up and into a ceiling passage or plenum, then back down and to the end location.

As stated, interior walls in offices, hotels and the like are typically made by erecting a frame that includes vertical studs, either wood or steel, on a 16" or 24" spacing, lining each side with gypsum board (sheet rock) panels, then finishing the wall surfaces with a variety of textures and paint. FIGS. 1*a*-1*d* illustrate a cross-sectional top-down view of such constructions.

FIG. 1*a* shows a wall construction 100 comprised of vertical 2×4 studs 102 lined on each side by ⅝" gypsum board 101 with empty space 103 therebetween. FIG. 1*b* shows a wall construction 200 comprised of vertical 2×4 studs 202 lined on each side by ⅝" gypsum board 201 with insulation 203 filling the interior space.

FIG. 1*c* shows a wall construction 300 comprised of 3½" vertical steel studs 302 lined on each side by ⅝" gypsum board 301. FIG. 1*d* shows a wall construction 400 comprised of 3½" vertical steel studs 402 lined on each side by ⅝" gypsum board 401 with insulation 403 filling the interior space.

For the primary objective of increasing the sound attenuating properties of walls, numerous alternative practices have been used. FIGS. 1*e*-1*g* provide top-down cross-sectional views of alternative constructions.

FIG. 1*e* shows a wall construction 500 wherein vertical 2×4 studs 502 are placed in a staggered configuration such that no direct rigid connection is made between gypsum board panels 501 lining each wall face. Insulation 503 is used to fill interior spaces.

FIG. 1*f* shows a wall construction 600 wherein vertical 2×4 studs 602 are placed in a two-wide configuration effectively doubling the overall wall thickness. Gypsum board 601 lines each face and insulation 603 fills interior spaces.

FIG. 1*g* is similar to FIG. 1*f* except the two-wide 2×4 studs are replaced by 7" steel studs 702 and two layers of gypsum board 701 are used on one side. Insulation 703 is used to fill interior spaces. The wall construction of FIG. 1*g*, by way of the double layer of gypsum board on one face provides a one hour fire rating as required by many commercial applications such as hotel constructions.

Based upon the state of the art as described in FIGS. 1*a*-1*g*, a wall construction is needed that effectively utilizes the favorable structural and acoustic properties of superior construction materials, namely compressed straw panels discussed infra, and preferably construction materials made primarily from recovered or otherwise discarded materials. Further, what is needed in the art is a wall construction method that is quicker and more cost effective to install than conventional wall constructions while providing easy routing and re-routing of increasing amounts of utility wiring and communication cables. Still further, what is needed in the art is a wall construction method that provides the flexibility and reconfigurability of currently available partial or full height partition systems while providing the sturdiness, sound attenuation and ease of resurfacing provided by conventional gypsum board walls. Finally, what is needed in the art is a wall construction that contains no exterior connectors such as nails, screws, and the like that require additional surface treatment to finish.

The current applicant's invention disclosed in pending U.S. patent application Ser. No. 10/715,258 provides a wall construction system that meets these stated needs of the art, while providing a system made primarily of recycled materials.

There further exists a need in the art, however, for a wall construction system and method that provides easy lateral movement of vertically oriented hat-channel studs while maintaining alignment along a wall line and which eliminates the need for a rigid attachment between the top and bottom of each hat-channel stud and the ceiling and floor respectively.

SUMMARY OF THE INVENTION

The present invention relates to the construction of interior and exterior walls and especially to the finishing or fitting-out of building space such as offices, hotels, conference centers, business centers, meeting rooms, medical facilities, classrooms, etc. Particularly, the present invention provides for the finishing out of open space using a system comprising a series of rails attached along a wall line to a ceiling and floor. Floor and ceiling rails are designed to hold a plurality of vertically oriented hat-channel shaped studs therebetween such that the studs are able to slide laterally along the wall line while being held between said floor and ceiling rails. Studs are laterally spaced at intervals approximately equal to the width of compressed straw building panels to be assembled thereon, but remain laterally moveable to provide for lateral adjustment as wall assembly proceeds. Compressed straw panels are attached to the studs in a specific systematic manner resulting a wall or partition that includes no exterior penetrations or connectors.

The result is a relatively seamless exterior surface that can be finished in a plurality of ways, but one that, if desired, can be utilized with minimal surface treatment. The finished wall is structurally strong, but substantially hollow, thus enabling very easy routing and re-routing of utility wiring there through. Said studs are provided with a plurality of horizontal opening through which utility wiring and communication cabling can easily be routed. Assembly is simple, fast and inexpensive relative to the construction of conventional interior walls primarily due to significant potential savings in labor costs. The features and advantages of the present invention will be further understood and appreciated by those skilled in the art by reference to the following written specification, claims, and appended drawings.

BRIEF DESCRIPTION OF THE DRAWINGS

The present invention should be more fully understood when the written description is considered in conjunction with the drawings contained herein, wherein.

DETAILED DESCRIPTION OF THE INVENTION

Figure 1A:
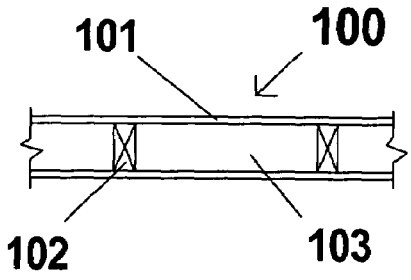
FIGS. 1*a*-1*g*, provide illustrations of known wall construction methods.
Figure 1B:
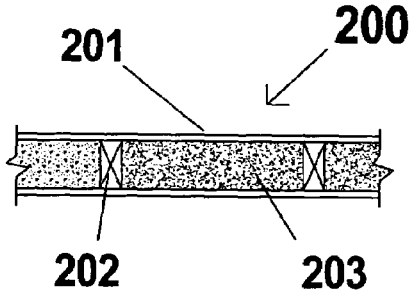
Figure 1C:
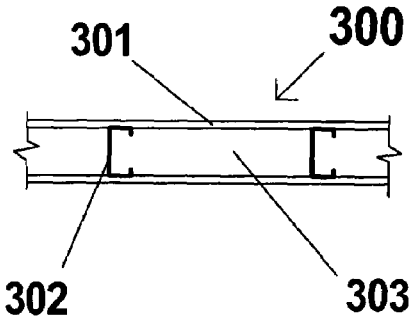
Figure 1D:
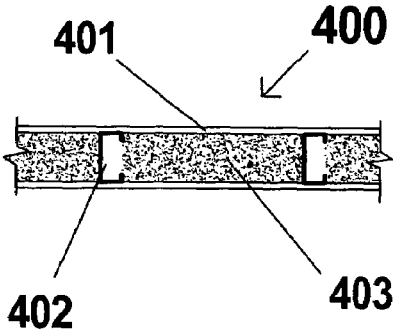
Figure 1E:
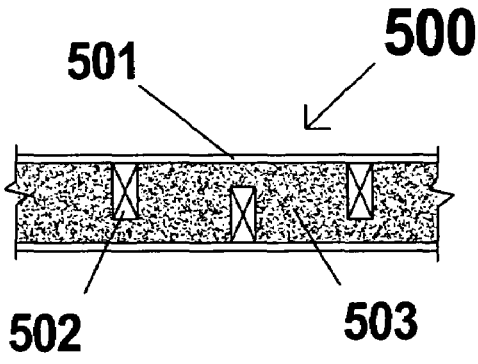
Figure 1F:
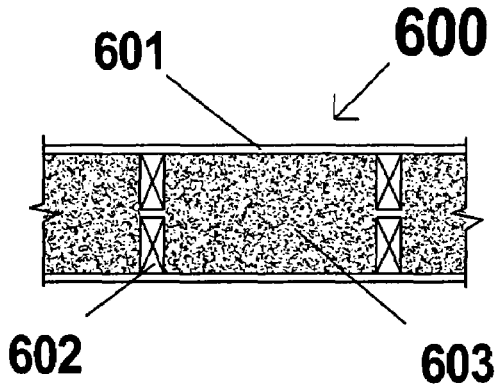
Figure 1G:
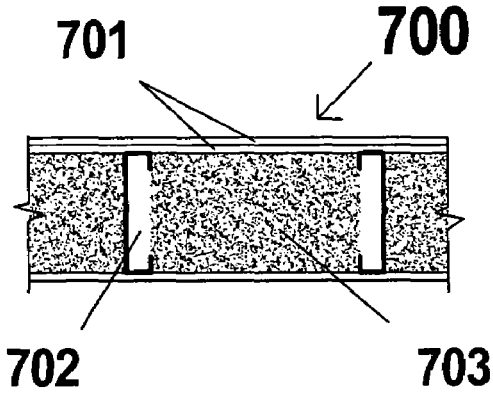

Though most of the background discussion, supra, implies an interior application, said construction is well suited for exterior wall constructions as well. In exterior applications, the hollow interior space may be used to contain supplemental thermal and/or acoustic insulation. Further, said compressed straw panels are well suited for accepting a variety of weather proof panels, coatings, or the like attached thereto.

The present invention preferably utilizes solid core compressed straw or strawboard panels comprised of a matrix of highly compressed straw, usually wheat, rice or other recovered agricultural straw, lined on all sides by paper or paperboard. Typically, the strawboard panels are made through a dry extrusion process wherein straw is compressed into a substantially flat continuous web, normally between 1½" and 3½" thick and between 40" and 60" wide. The continuous web is then cut into rectangular panels of various lengths. Panel length is easily varied. The compressed straw is arranged in layers with the straw fibers substantially parallel in orientation extending transversely across the strawboard panel from side to side when the strawboard panel is in a normal in-use orientation. Said strawboard panels are typically rectangular in shape, and for the purposes of this disclosure, will be oriented such that the longer edges are substantially vertical and the shorter edges are substantially horizontal. In this orientation, said straw fibers will assume a generally horizontal orientation. Said strawboard panels have a tackable surface, i.e., are suitable for securely accepting nails, tacks, screws and other connecting means for attaching and/or hanging items from the strawboard panel surfaces.

Further, surfaces of the strawboard panels are suitable for accepting surface texture, paint, wall paper, and other conventional wall coverings. Strawboard panels can be factory finished with surface texture, paint, wall paper and the like, or said surface treatments can easily be applied to a finished wall. Compressed strawboard panels are typically much thicker and stronger than gypsum board and possess higher nail pull values, thus providing nails, screws, or the like driven therein to support more weight than if driven into gypsum board. Additionally, said strawboard panels possess sound insulating properties superior to both conventional gypsum board walls and many currently available commercial interior partition systems.

Solid core strawboard panels further provide fire resistant properties superior to materials used in many presently available interior wall construction and partition systems. To enhance flexibility, these strawboard panels can be cut and formed in the field using conventional tools such as circular, saber or band saws, routers, drywall hand saws, utility knives and the like. Ideally, however, the wall will be designed so that field alteration of said strawboard panels is minimized, thus minimizing installation time and costs. In the preferred embodiment, strawboard panels manufactured by Affordable Building Systems of Texas are used.

Figure 3B:
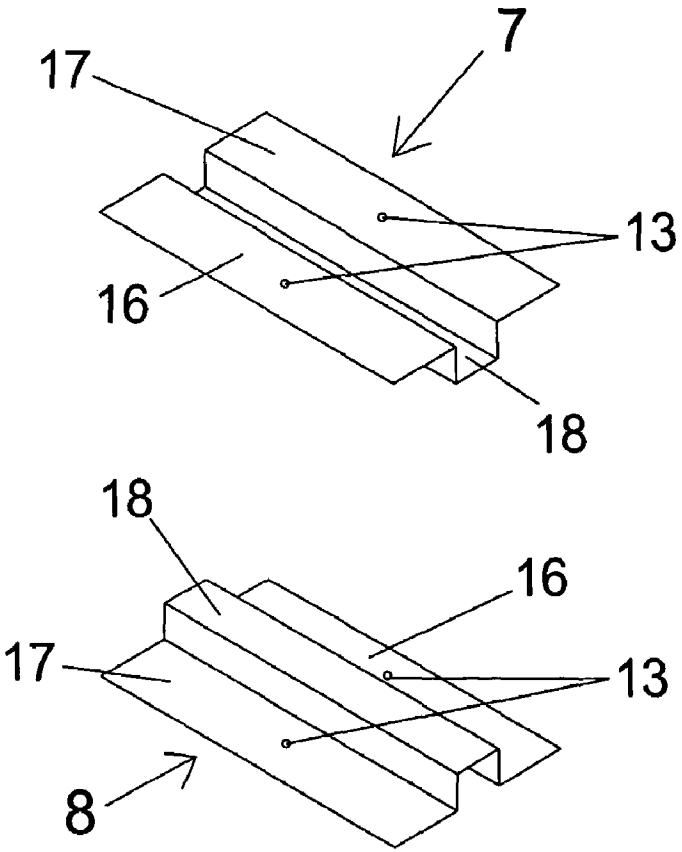
FIG. 3*b* shows an isometric detailed view of our floor and ceiling rail.
Figure 3A:
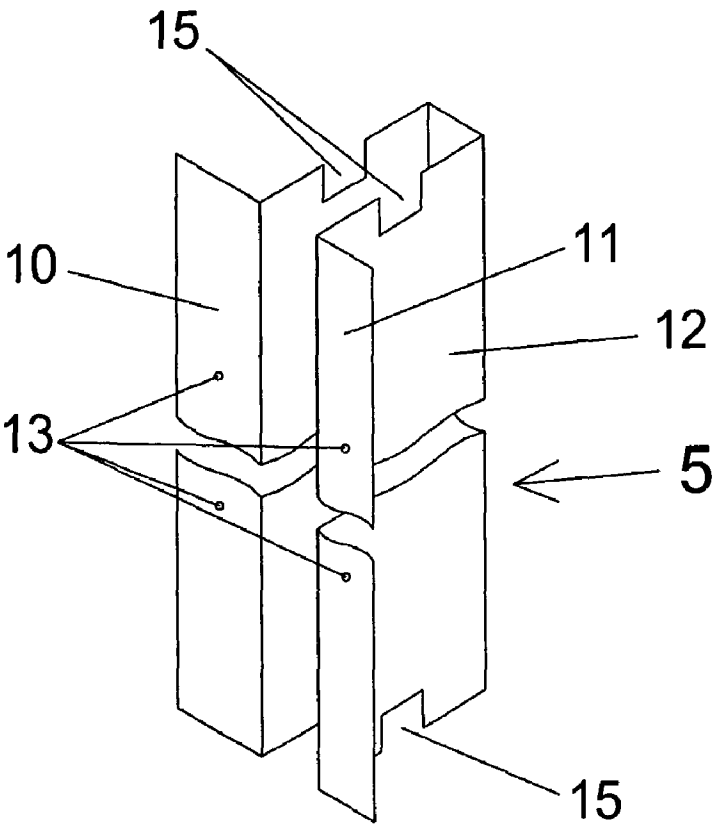
FIG. 3*a* shows an isometric detailed view of our sliding flanged stud.

Referring first to FIG. 3*a*, a detailed isometric view of our flanged stud 5 is provided and is shown to comprise a large flange 10 and a small flange 11 in a substantially co-planar position and disposed about a spine channel 12, said spine channel 12 comprising the entire portion of flanged stud 5 except large flange 10 and small flange 11. As illustrated, each spine channel 12 is provided with a pair of laterally disposed rail guides 15 at each end. Both large flange 10 and small flange 11 are provided with a plurality of lag screw receivers 13 for accepting the shaft of a properly sized lag screw therein.

The relative dimensions of large flange 10, small flange 11 and spine channel 12 are variable and can be changed to meet specific criteria such as wall depth. It should be noted that throughout this disclosure flanged stud 5 is shown as having a large flange 10 and a small flange 11. This size differentiation is done largely for descriptive purposes, and said flanges can alternatively be the same size.

Flanged stud 5 is preferably made from 16 gauge steel, but alternately can be made from any material, metal or non-metal, that provides comparable strength and stiffness and preferably a comparable or higher melting temperature (~2500° F.).

FIG. 3*b* provides a detailed isometric view of ceiling rail 7 and floor rail 8, each comprised of a first flange 16, and second flange 17, and a raised channel 18 disposed between said flanges. Said first flange 16 and second flange 17 are each preferably provided with a plurality of lag screw receivers 13 for accepting the shaft of a properly sized lag screw therein. It can be seen that ceiling rail 7 and floor rail 8 are identical pieces in opposite orientation and can be used interchangeably in a preferred embodiment. Both floor rail 8 and ceiling rail 7 are preferably made from 16 gauge steel, but can be made from any material, metal or non-metal, that provides comparable strength and stiffness and a comparable or higher melting temperature (~2500° F.). The actual gauge needed will depend upon the specific application and may be heavier or lighter than 16 gauge.

Figure 2:
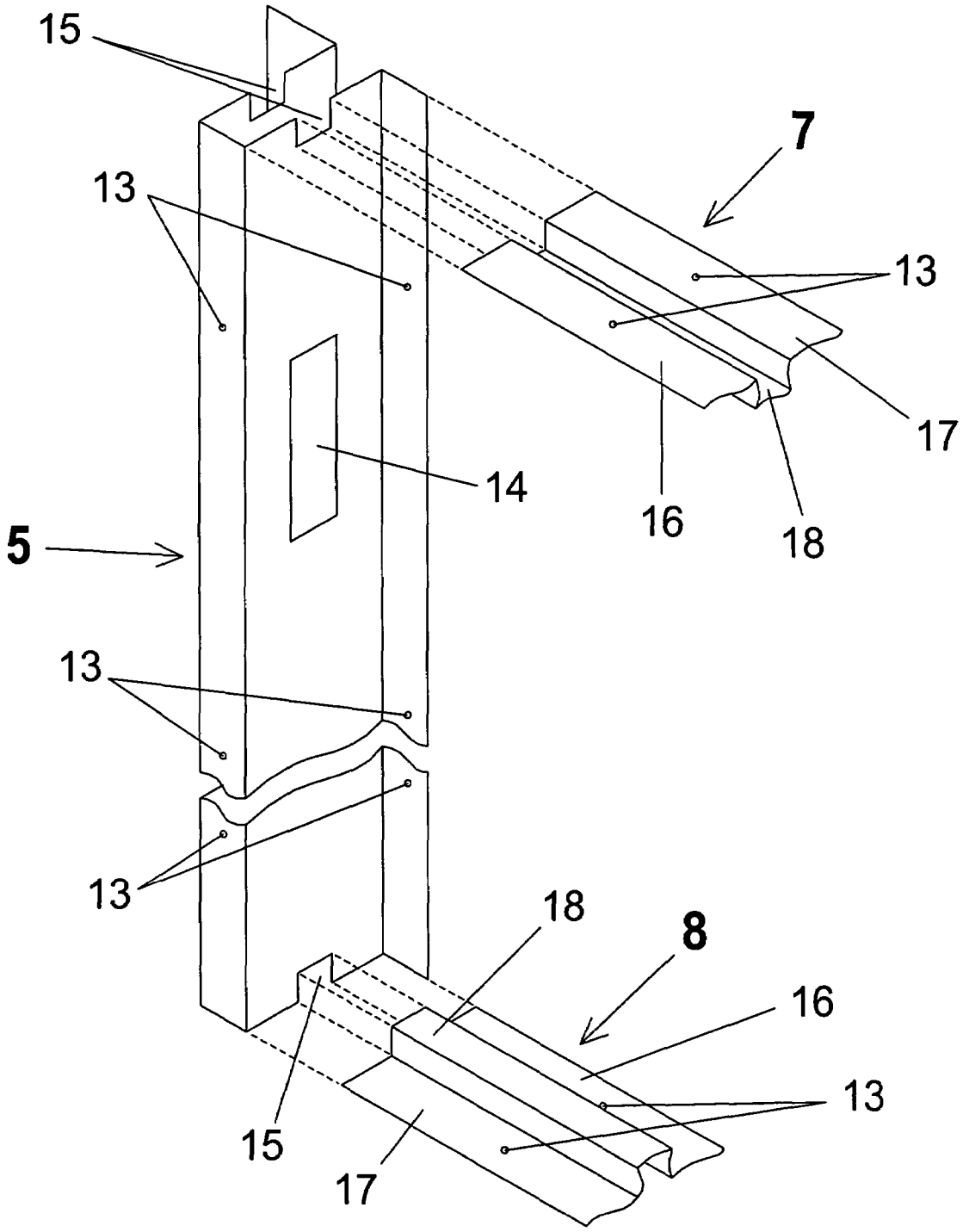
FIG. 2 shows an isometric view of our sliding flanged stud and the associated floor and ceiling rails.

FIG. 2 provides an isometric view of an assembly of a flanged stud 5 positioned between a floor rail 8 and a ceiling rail 7. Flanged stud 5 is preferably provided with a utility opening 14 that allows for the routing of utilities such as power wiring and communication cables through the interior of a finished wall. Typically, each flanged stud 5 is provided with a plurality of utility openings 14. FIG. 2 specifically illustrates the interaction between said rail guides 15 and raised channels 18. Each rail guide 15 and raised channel 18 is designed and sized to provide component interaction that allows flanged stud 5 to slide laterally in a plane defined by the lateral center lines of opposed floor rail 8 and ceiling rail 7, while preventing flanged stud 5 from moving out of said plane. Said plane then defines the centerline of the finished wall.

FIG. 2 further illustrates that the first flange 16 and second flange 17 of both the floor rail 8 and ceiling rail 7 are preferably sized so as to make a flush fit along the end of flanged stud 5 when each components are assembled. Each rail guide 15 is preferably sized to provide a horizontal clearance of approximately ¼" between said rail guide 15 and each raised channel 18 properly positioned there through.

Figure 4B:
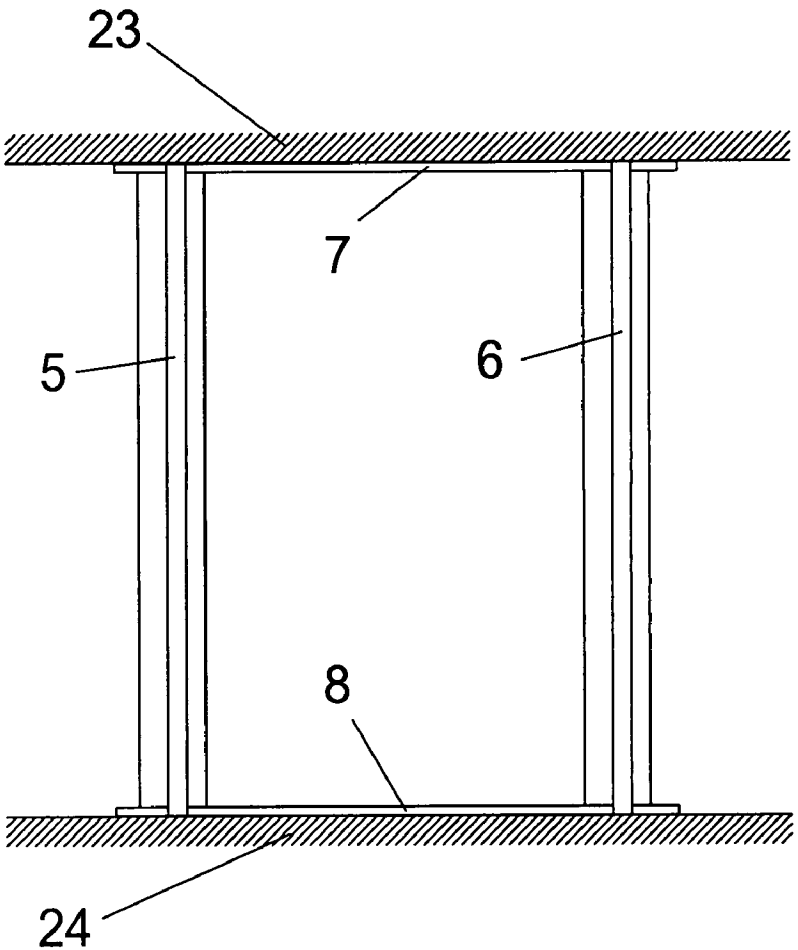
FIG. 4*b* shows a side view of our assembly comprising first and second sliding flanged studs properly positioned and held between a floor and ceiling rail.
Figure 4A:
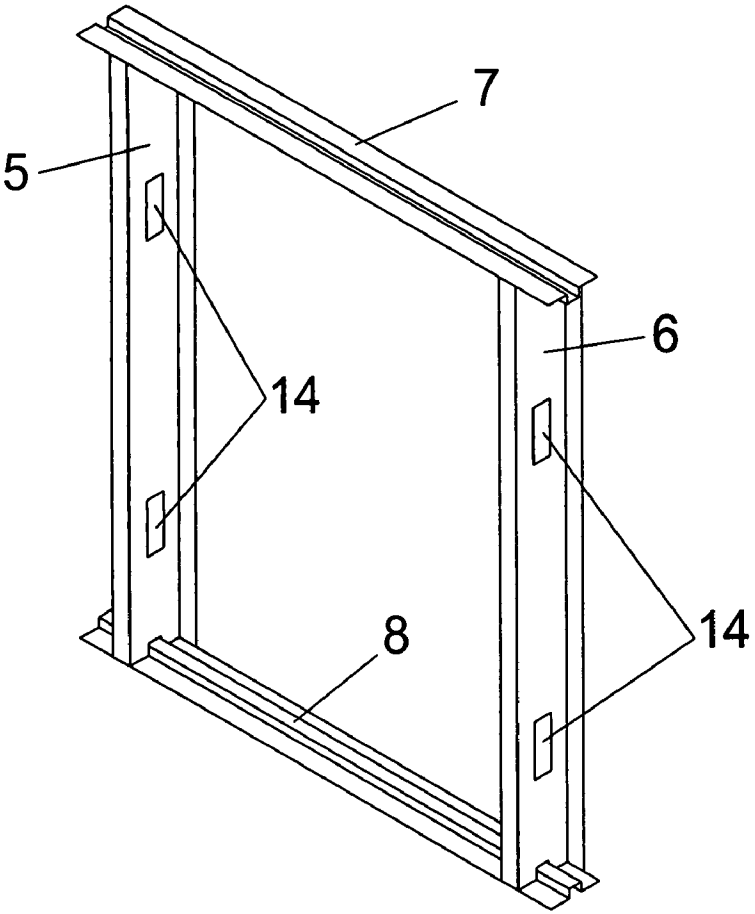
FIG. 4*a* shows an isometric view of our assembly comprising first and second sliding flanged studs properly positioned and held between a floor and ceiling rail.

FIGS. 4*a* and 4*b*, respectively, provide isometric and side views of our new wall frame assembly comprising floor rail 8, ceiling rail 7 and a first flanged stud 5 and second flanged stud 6 properly disposed therebetween.

FIG. 4*a* further provides a view of first flanged stud 5 and second flanged stud 6 each provided with a plurality of utility openings 14.

FIG. 4*b* illustrates the contact and implied connection between floor rail 8 and floor 24 and between ceiling rail 7 and ceiling 23. The respective connections between floor rail 8 and floor 24 and between ceiling rail 7 and ceiling 23 can be made by an number of suitable means such as screws, nails, bolts, anchor bolts, adhesive, etc., When an installation requires ceiling rail 7 to be attached to runner of a suspended ceiling or the like, a clip connection or the like may be used in place of screws or adhesive.

The step by step assembly of a wall according to the present invention is illustrated in FIGS. 5*a*-5*f* which provide isometric sectional views of our wall assembly as it is being assembled. Note that the views provided in FIGS. 5*a*-5*f* are sectional views, and the ceiling rail 7 as well as top of first and second flanged stud 5, 6 and the top of each strawboard panel 1,2,3,4 are not shown.

Figure 5A:
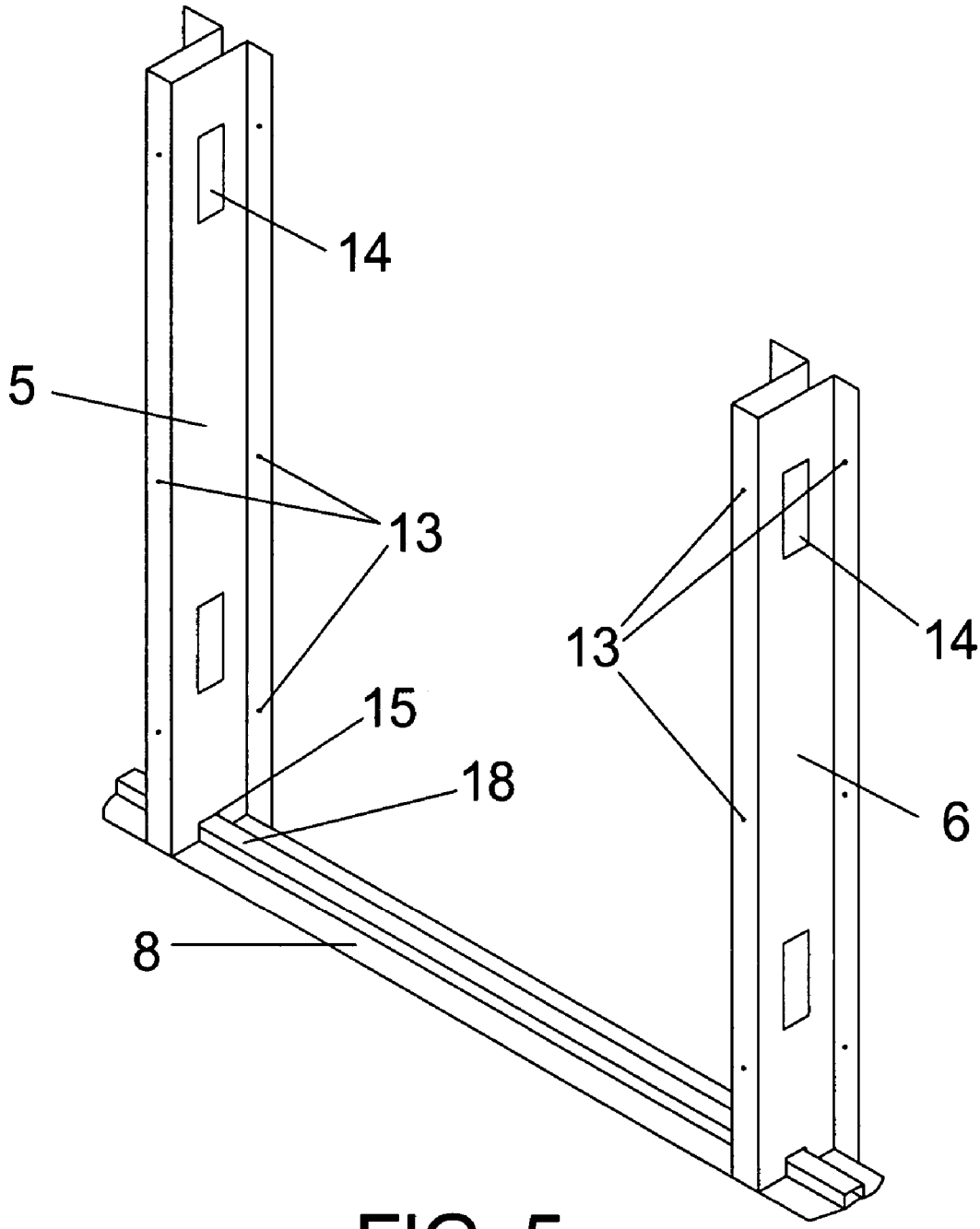
FIG. 5*a* shows an isometric sectional view of the assembly shown in FIG. 4.

In FIG. 5*a*, floor rail 8, first flanged stud 5, and second flanged stud 6 are shown in assembled form. It can be seen that both first and second flanged studs 5, 6 are preferably provided with a plurality of utility openings 14 and lag screw receivers 13. The designed fit of raised channel 18 and rail guide 15 can also be seen. As previously stated, in the assembled form, i.e., a flanged stud is positioned between ceiling rail and a floor rail with raised channels residing in rail guides at both ends, said stud will be moveable laterally along a plane defined by the opposed ceiling and floor rails.

Figure 5B:
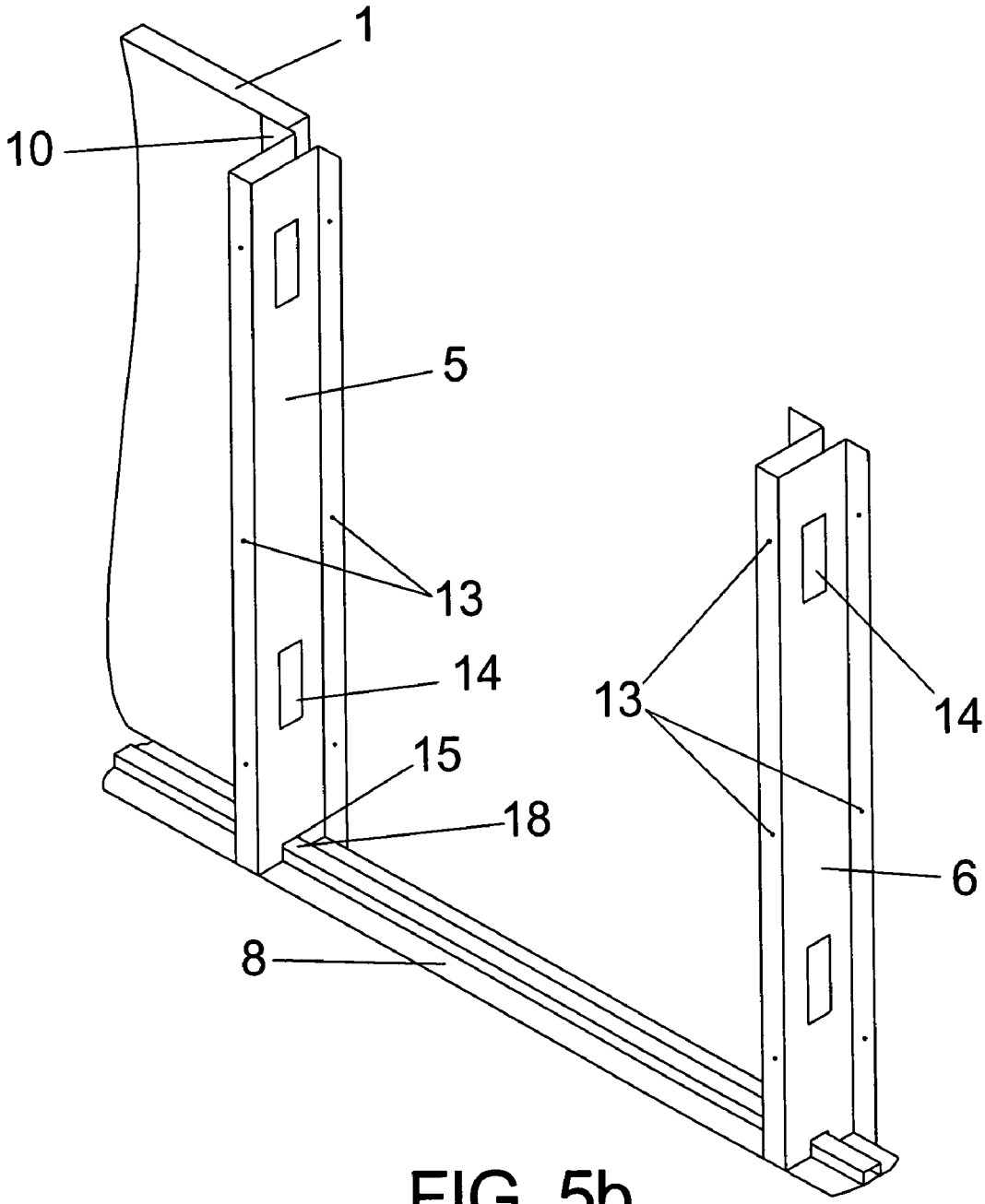
FIG. 5*b* shows the assembly of FIG. 5*a* with a first strawboard panel attached.

In FIG. 5*b* a first strawboard panel 1 is shown positioned in substantially co-planar relation to the wall centerline and adjacent to the large flange 10 on first flanged stud 5. Though not shown, first strawboard panel 1 is rigidly attached to said large flange 10 by means of screws, nails, or other penetrating connectors. In the preferred embodiment, said rigid attachment is made by means of 1½" lag screws.

Figure 6:
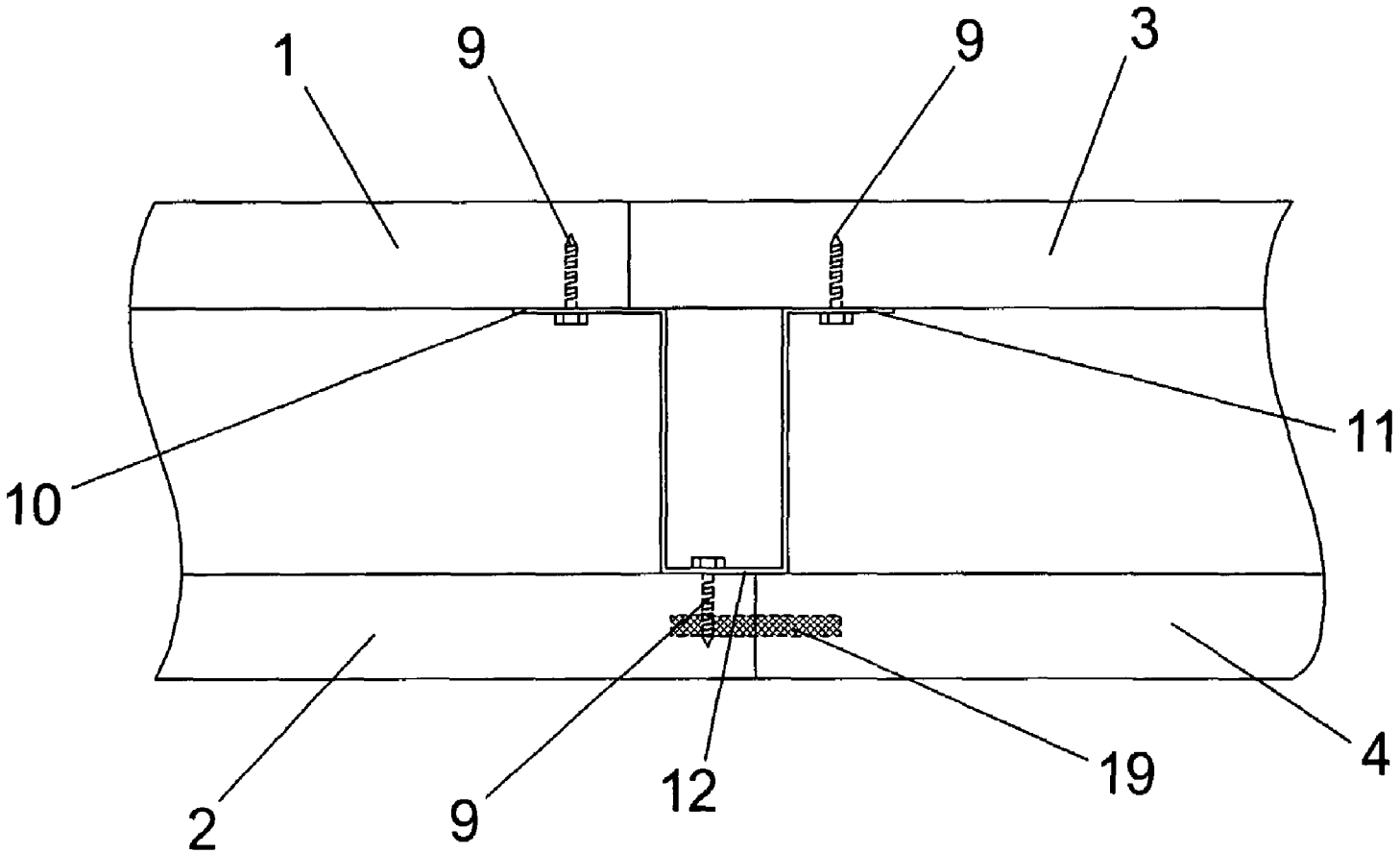
FIG. 6 provides a top-down sectional detail of the connection between strawboard panels and flanged stud.

Referring to FIG. 6 which provides a top-down cutaway view of preferred strawboard panel-stud connections, the connection between first strawboard panel 1 and large flange 10 is shown. Attachment is made be means of a plurality of 1½" lag screws 9 inserted through lag screw receivers 13 (not shown) and penetrating first strawboard panel 1. Further, it is important that first strawboard panel 1 does not completely cover the outer face of large flange 10 so as to provide room for third strawboard panel 3 to contact a portion of large flange 10 when in abutted edge-to-edge relation to first strawboard panel 1. Throughout this disclosure, lag screws are used for illustration and are the connector of choice, but nails or other suitable penetrating connectors may be used. Lag screws provide for easy disassembly of a wall with minimal damage to strawboard panels.

Figure 5C:
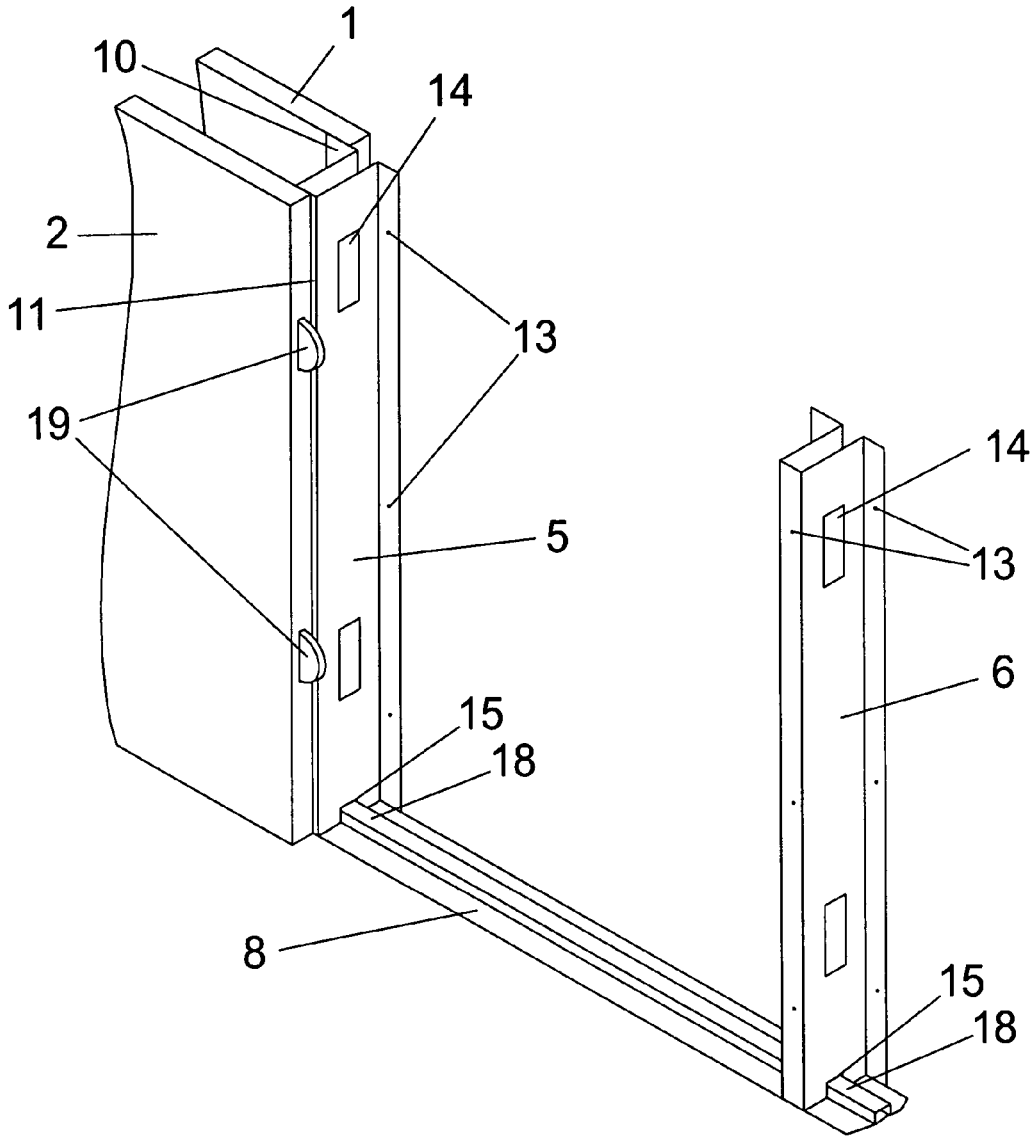
FIG. 5*c* shows the assembly of FIG. 5*b* with a second strawboard panel attached.

FIG. 5*c* shows second strawboard panel 2 positioned in co-planar relation to first strawboard panel 1 and positioned adjacent to the outer face of spine channel 12. A plurality of disc connectors 19 can be seen protruding from the edge of second strawboard panel 2. Said disc connectors, disclosed in U.S. Pat. No. 6,634,077 and pending U.S. application Ser. No. 10/387,994 are preferably inserted in fitted receivers (not shown). FIG. 6 provides illustration of the arrangement between second strawboard panel 2 and spine channel 12 including rigid connection by means of a plurality of lag screws 9 inserted through lag screw receivers 13 (not shown) and penetrating second strawboard panel 2 to provide a rigid attachment thereto. It is important to point out here that second strawboard panel 2 preferably does not completely cover the outer face of spine channel 12 so as to leave room for a portion of fourth strawboard panel 4. FIG. 6 also illustrates the connection between second strawboard panel 2 and fourth strawboard panel 4 by means of a plurality of disc connectors 19.

Figure 5D:
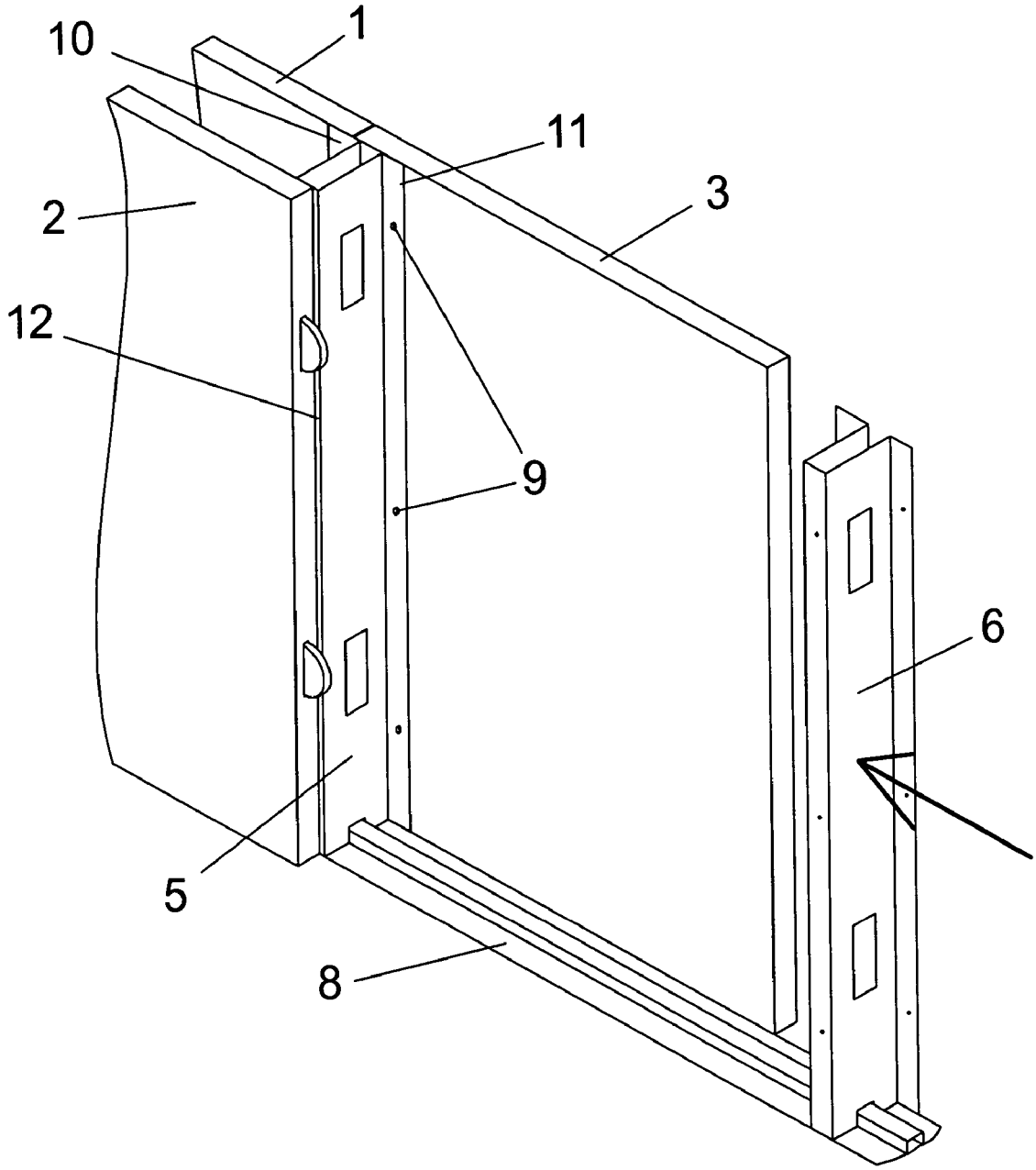
FIG. 5*d* shows the assembly of FIG. 5*c* with a third strawboard panel positioned and illustrates the lateral adjustment of second sliding flanged stud.
Figure 5E:
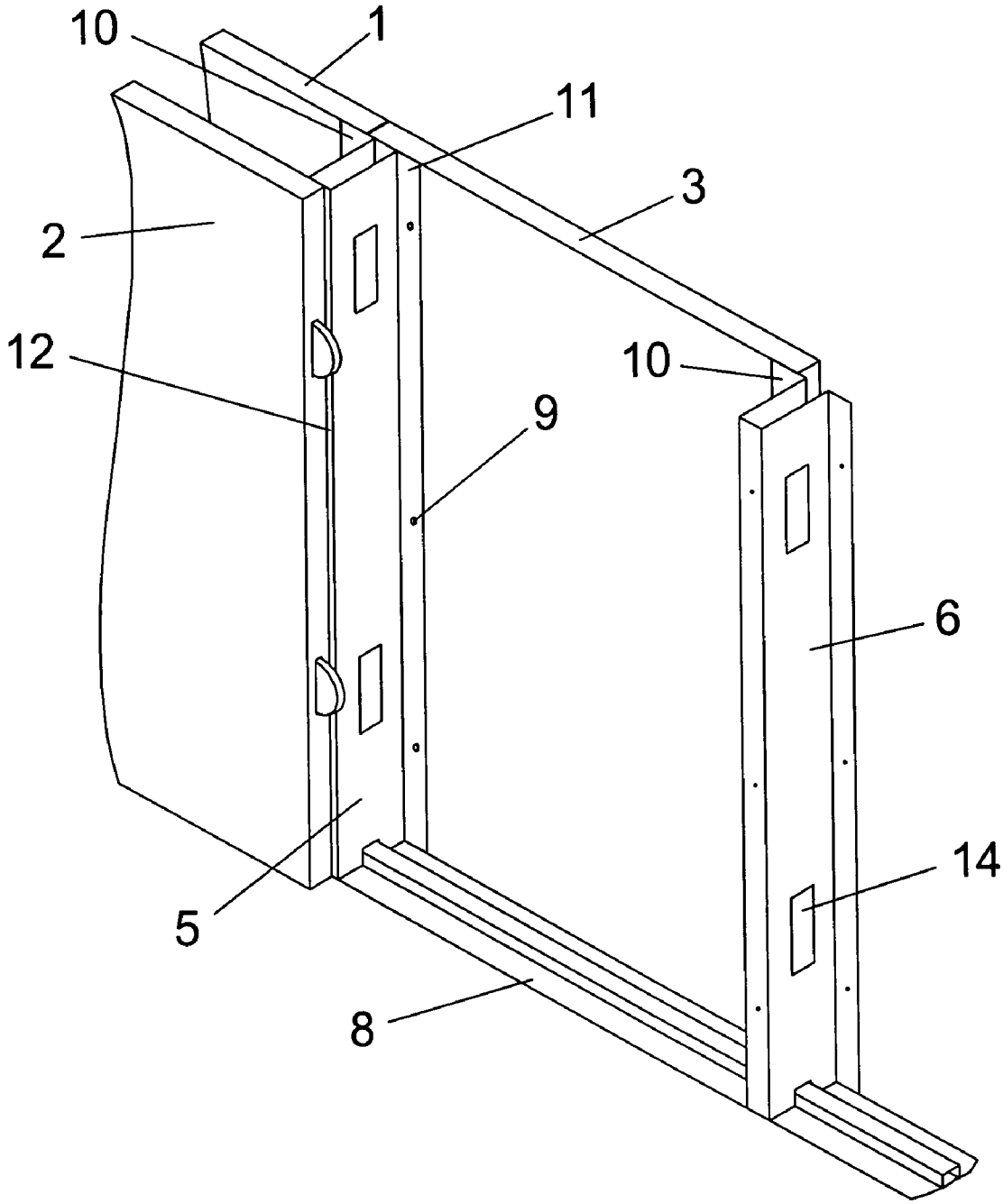
FIG. 5*e* shows the assembly of FIG. 5*d* with a third strawboard panel attached.

FIG. 5*d* shows third strawboard panel 3 properly positioned in co-planar and abutted edge to edge relation with first strawboard panel 1 and secured to small flange 11 of first flanged stud 5 by means of lag screws 9. A primary feature of this invention is illustrated by the large inward-facing arrow adjacent to second flanged stud 6, said arrow indicating that second flanged stud 6 can be laterally moved along floor rail 8 and ceiling rail 9 (not shown) into proper position for accepting connection to third strawboard panel 3. FIG. 5*e* then shows second flanged stud 6 in the desired lateral position for connection to third strawboard panel 3. As with the other strawboard panels, the connection between third strawboard panel 3 and second flanged stud 6 is preferably achieved by means of a plurality of 1½" lag screws inserted through lag screw receivers and secured within said third strawboard panel 3.

Figure 5F:
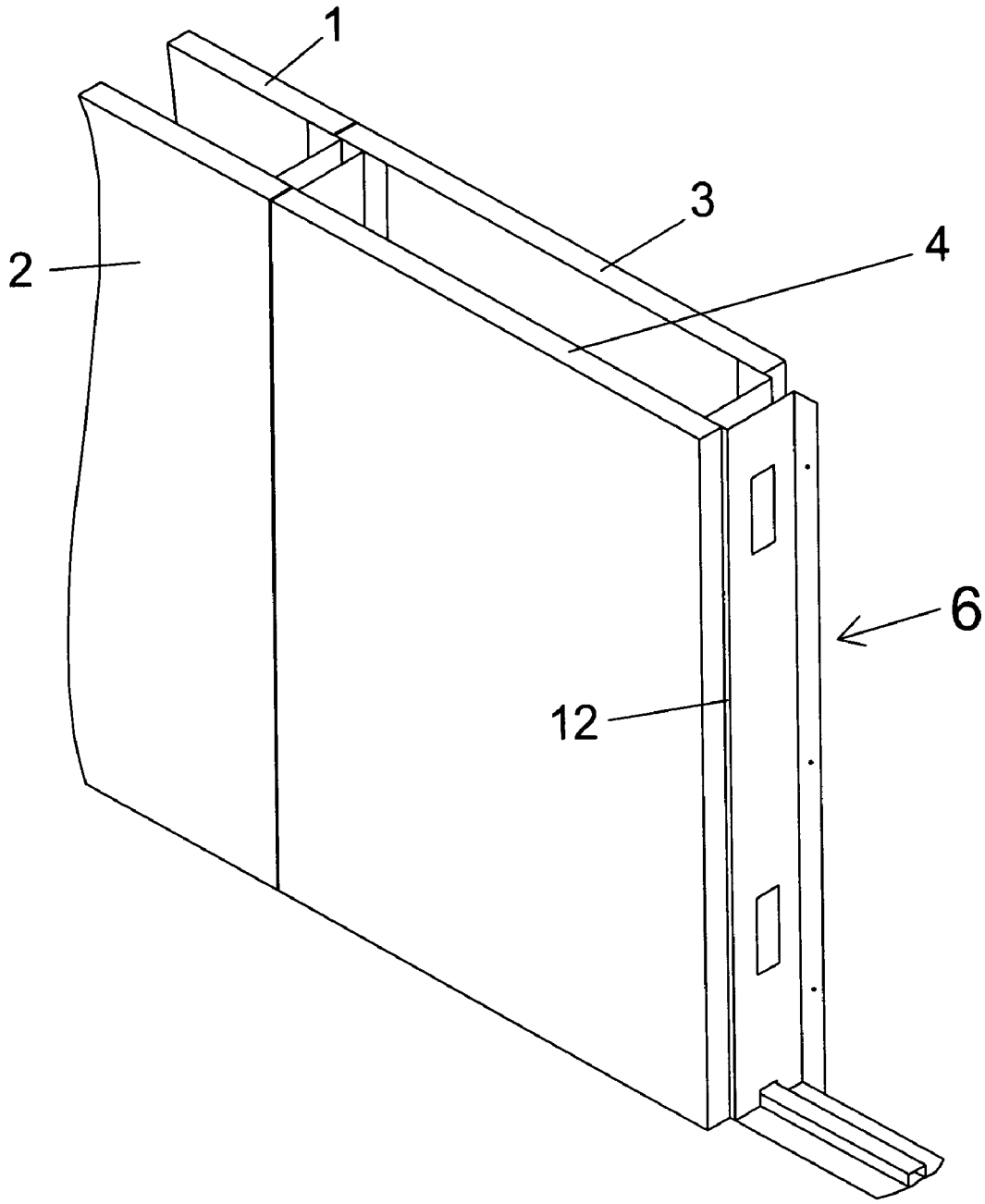
FIG. 5*f* shows the assembly of FIG. 5*e* with a fourth strawboard panel attached.

FIG. 5*f* shows fourth strawboard panel 4 properly placed in co-planar and abutted edge to edge relation to second strawboard panel 2. A connection between fourth strawboard panel 4 and second flanged stud 6 is made by via a plurality of lag screws 9 positioned through lag screw receivers 13 located on the outer face of spine channel 12 of second flanged stud 6. Connection between fourth strawboard panel 4 and second flanged stud 6 as well as the connection between second strawboard panel 2 and fourth strawboard panel 4 are illustrated in FIG. 6. The connection between second strawboard panel 2 and fourth strawboard panel 4 is preferably achieved by means of a plurality of disc connectors 19 positioned within connector receivers located in the facing edges of second strawboard panel 2 and fourth strawboard panel 4.

Figure 7B:
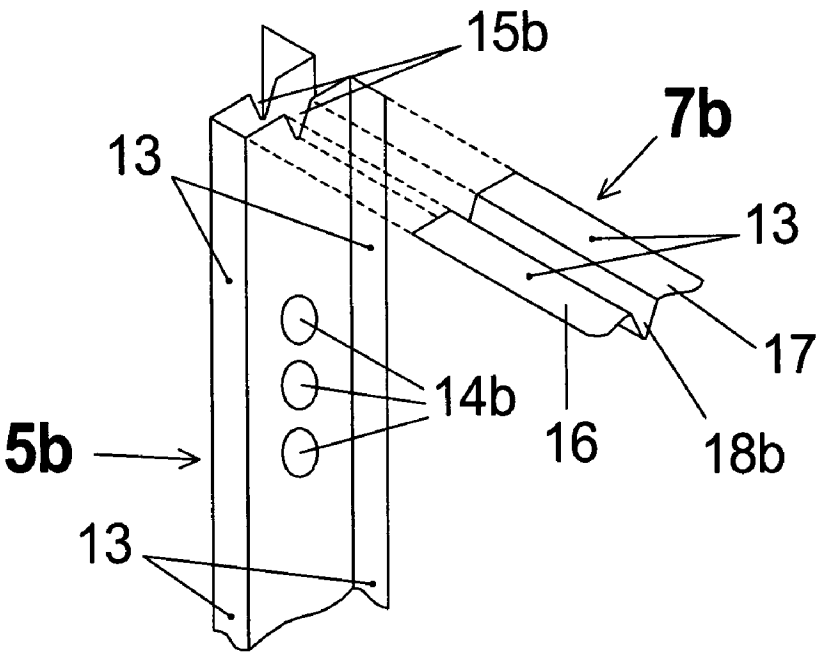
FIG. 7 provides an isometric view of two alternative embodiments of floor rail, ceiling rail and flanged stud.
Figure 7A:
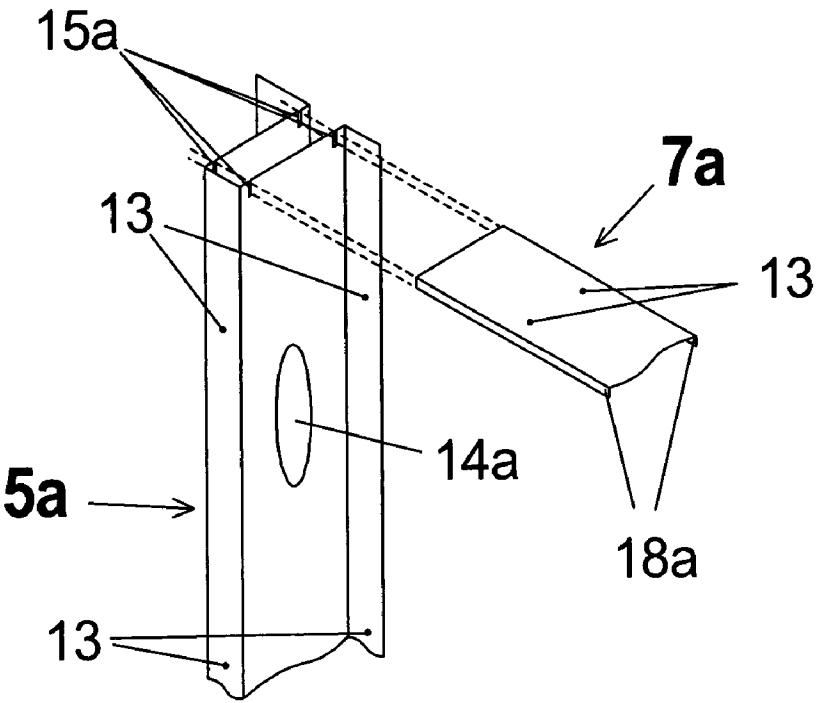

FIGS. 7*a* and 7*b* illustrate alternative embodiments of the ceiling rail 7, floor rail 8 (not shown), and flanged stud 5. FIG. 7*a* illustrates an alternative ceiling rail 7*a* which contains two raised flanges 18*a* in lieu of raised channel 18 (not shown). Further, rail guides 15 (not shown) are replaced by two receiving slits (18*a*) positioned on the end of alternate flanged stud 5*a* such that raised flanges 18*a* can be slidably received therein. Also on flanges stud 5*a*, utility opening 14 has been replaced by a non-rectangular alternate utility opening 14*a*.

FIG. 7*b* illustrates a second alternative ceiling rail 7*b* comprising a raised channel 18*b* with a substantially triangular cross section in lieu of the substantially rectangular shape in the preferred embodiment. Alternative rail guides 15*b* located on the end of flanged stud 5*b* are comparably shaped to slidably receive raised channel 18*b* therein. Alternative utility openings 14*b* are provided as small group of circular openings.

FIGS. 7*a* and 7*b* illustrate only the top portions of alternative flanged stud 5*a* and 5*b*, as well as only associated ceiling rails 7*a* and 7*b*, but it should be noted that for both alternative embodiments, as with the preferred embodiment, the ceiling and floor rails can be identical components and the rail guides provided on each end of flanges studs can be identical. Thus, FIGS. 7*a* and 7*b* effectively illustrate both the ceiling and floor rails as well as the rail guides located at both ends of each flanged stud.

Figure 8A:
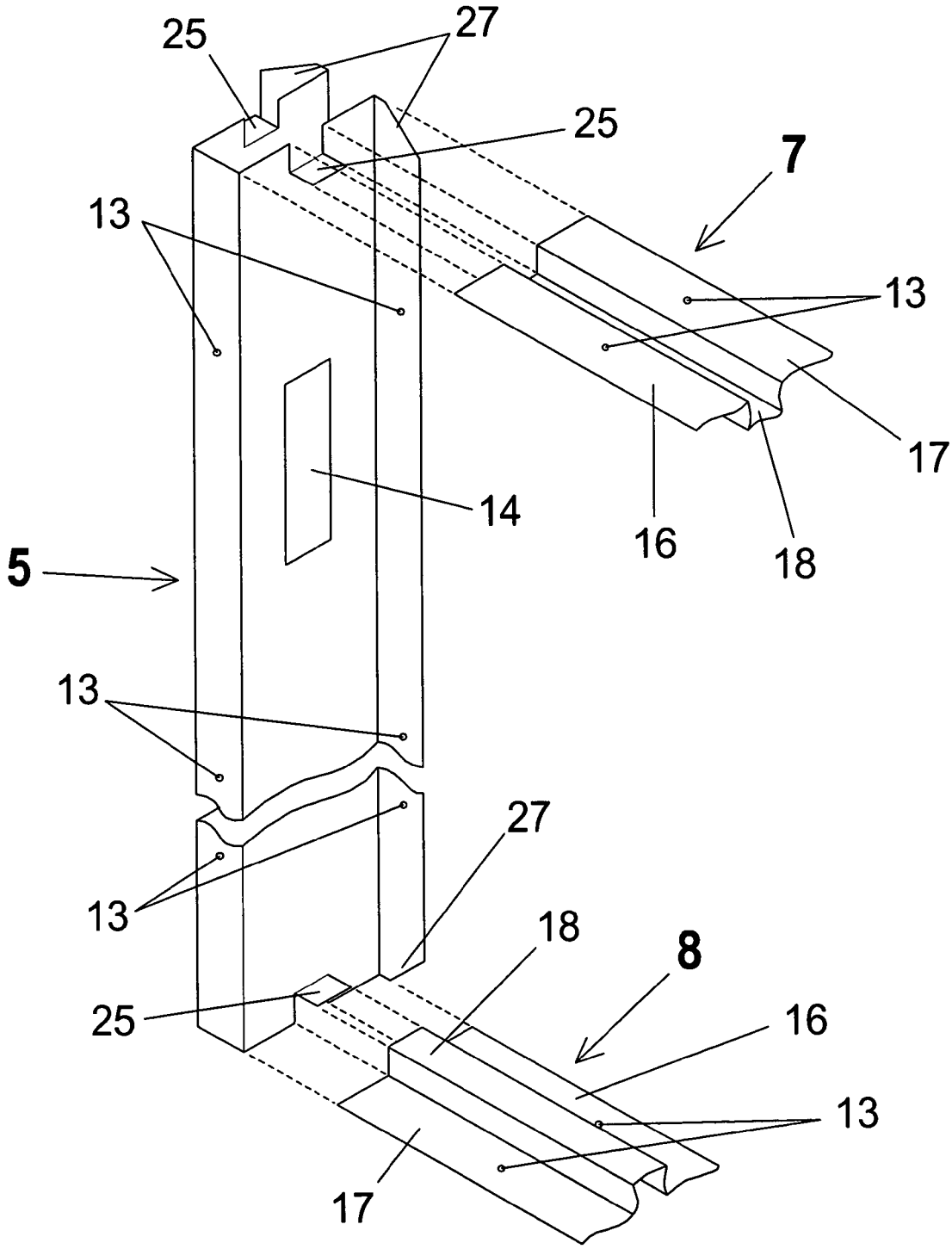
FIGS. 8*a* and 8*b* provide isometric views of a third alternative embodiment of flanged stud.
Figure 8B:
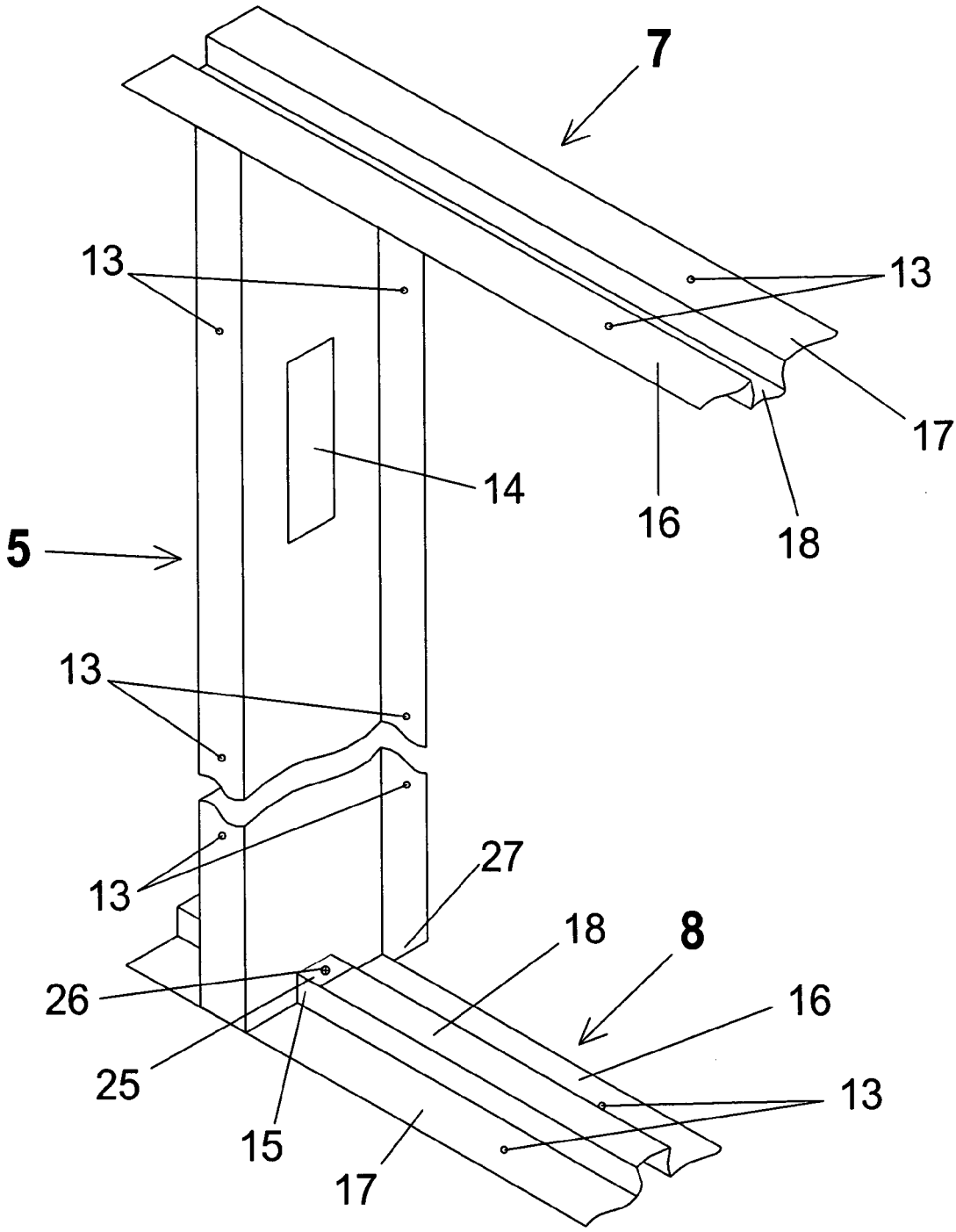
Figure 9B:
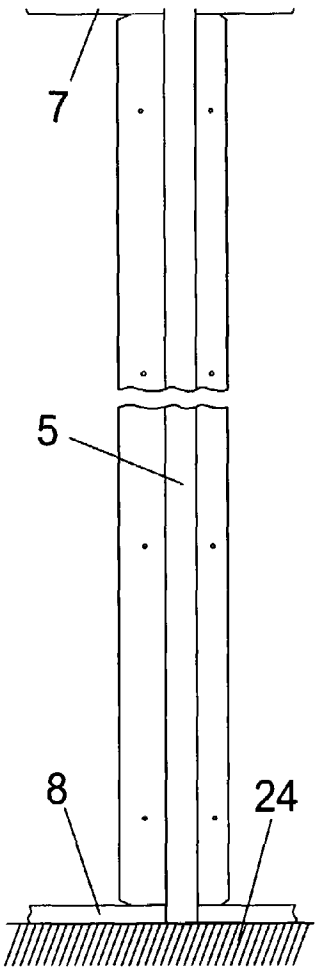
FIGS. 9*a* and 9*b* provide a side view and installation details of a third alternative embodiment of flanged stud.
Figure 9A:
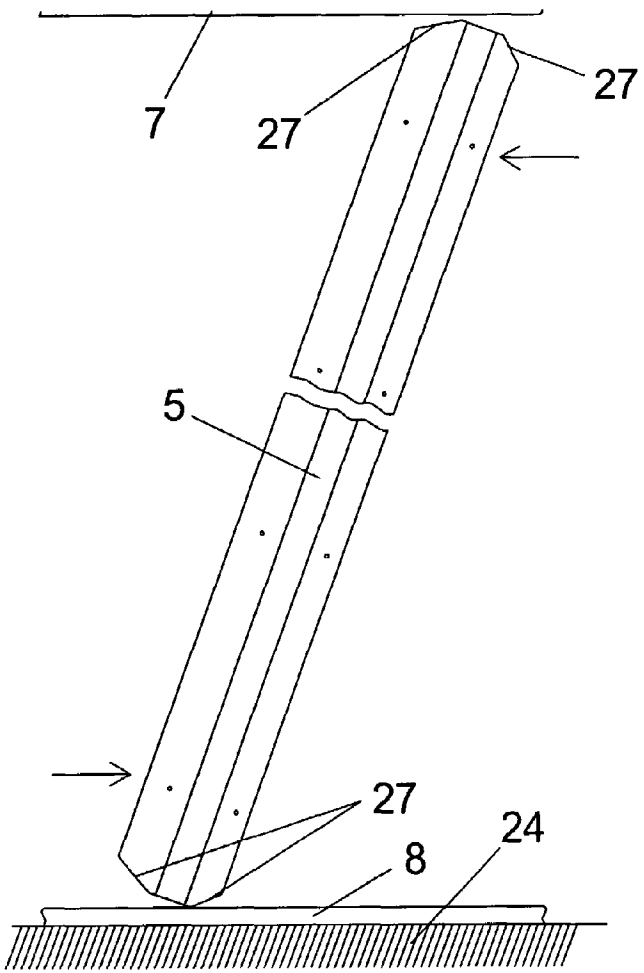

FIGS. 8*a* and 8*b* illustrate additional alternative embodiments of flanged stud 5. In both FIG. 8*a* and FIG. 8*b* anchor tab 25 is illustrated. Said anchor tab 25 is included to provide a convenient means for providing a secure attachment between the top of flanged stud 5 and ceiling rail 7 and between the bottom of flanged stud 5 and floor rail 8. This feature allows for the flexibility of placing a flanged stud 5 in a predetermined position between ceiling rail 7 and floor rail 8, then securing the stud in place by means of self-tapping screw 26 or comparable attachment means placed through said anchor tab 25 and secured to raised channel 18 portion of each ceiling rail 7 and floor rail 8. Also illustrated in FIG. 8*a* and FIG. 8*b*, the ends of large flange 10 and small flange 11 each have been tapered 27 with said taper 27 increasing from center to edge. As illustrated in FIGS. 9*a* and 9*b*, said taper 27 provides for the placement of a flanged stud 5 in between a floor rail 8 and ceiling rail 7 by means of in-place lateral rotation after said stud has been properly positioned.

As noted supra, each rail guide 15 is preferably sized to provide a horizontal clearance between said rail guide 15 and horizontal edge of raised channel 18 portion of each floor rail 8 and ceiling rail 7. Said horizontal clearance and flange taper 27 provide for an unencumbered in-place lateral rotation of flanged stud 5.

The embodiments which have been shown and described are exemplary. Even though numerous characteristics and advantages of the present invention have been described in the drawings and accompanying text, the description is illustrative only, and changes may be made in the detail, especially in matters of shape, size, and arrangement of the parts without departing from the scope of the present invention.

What is claimed is:

1. An improved wall construction for positioning a plurality of rigid, self-supporting panels to provide exterior walls and/or divide or partition interior building space, said panels having a substantially rectangular shape with an inner and outer face and a top edge, a bottom edge, a front edge and a rear edge, said wall construction comprising:

a plurality of top rail members each having a substantially flat elongated rectangular shape with a first end and a second end and having a raised spine member spanning from first to second end, said rail members suitable for placement along the top of a wall line in end-to-end relative arrangement;

a plurality of bottom rail members each having a substantially flat elongated rectangular shape with a first end and a second end and having a raised spine member spanning from first to second end, said rail members suitable for placement along the bottom of a wall line in end to end relative arrangement; and a plurality of vertically oriented flanged stud members each having a top end and a bottom end and a substantially hat-shaped cross section that includes a large flange and a small flange joined together by a spine channel located therebetween, said large flange, small flange, and spine channel each having a substantially flat outer surface with said outer surfaces in substantially parallel respective position and said large and small flanges being in planar respective position, said top and bottom ends each having a lateral slot for slidably receiving said raised spine members of said top and bottom rails therein, said lateral slot oriented substantially parallel to said small and large flange, each said flanged stud member further disposed between a top and bottom rail member, thereby providing a frame suitable for the reception of one or more rigid, self-supporting panels, and further comprising:

a first panel positioned adjacent to said large flange on a first flanged stud member such that inner face of said first panel is in contact with outer surface of said large flange with said front edge of first panel in substantially parallel alignment with said first flanged stud member and inner face of said first panel partially covers outer surface of said large flange, said first panel further being connected to said first flanged stud member by means of a plurality of penetrating connectors positioned through said large flange and terminating within said first panel;

a second panel positioned with inner face adjacent to said outer surface of spine channel on first flanged stud member such that said front edge of second panel is in substantially parallel alignment with said first flanged stud member and inner face of said second panel covers a portion of the outer surface of said spine channel, said second panel further being connected to said first flanged stud member by means of a plurality of penetrating connectors positioned through said spine channel and terminating within said second panel, said second panel further having a plurality of symmetric recesses centered along said front edge, said recesses each being furnished with a symmetric connector inserted therein such that one-half of each symmetric connector extends outward from said front edge;

a third panel positioned with rear edge in abutted relation to front edge of said first panel and inner face adjacent to outer surface of both large and small flange of said first flanged stud member, said third panel further being connected to said first flanged stud member by means of a plurality of penetrating connectors positioned through said small flange and terminating within said third panel; and a fourth panel positioned with inner face adjacent to said outer surface of spine channel of said first flanged stud member, said fourth panel further having a plurality of symmetric recesses centered along said rear edge, said recesses positioned to receive protruding portions of symmetric connectors located along front edge of said second panel therein as rear edge of said fourth panel is placed in abutted relation to front edge of said second panel.

2. The improved wall construction of claim 1 wherein each end of said large and small flange of each flanged stud member is tapered.

3. The improved wall construction of claim 1 wherein each said lateral slot includes an adjacent tab with each said tab positioned to lie adjacent to a said raised spine member slidably received within said lateral slot.

4. The improved wall construction of claim 3 wherein each said flanged stud is attached to said top and bottom rails by means of a penetrating fastener positioned through said tab and terminating in said raised spine member.

5. The improved wall construction of claim 4, wherein said penetrating fastener includes a screw, nail, bolt, rivet, brad, tack, or staple.

6. The improved wall construction of claim 1 wherein each spine channel includes a plurality of horizontal openings, said openings arranged in opposed pairs with each pair positioned normal to a horizontal lateral axis and shaped to provide for passing of wires, cables and the like there through.

7. The improved wall construction of claim 1 wherein each said lateral slot is selected from the group of a square slot, a rectangular slot, a triangular slot, a semicircular slot, and a semi-elliptical slot.

8. The improved wall construction of claim 1 wherein said penetrating connector is selected from the group of nails, brads, tacks, screws, lag screws, rivets, bolts, lag bolts, machine bolts, carriage bolts, stove bolts, toggle bolts, anchor bolts, staples and rivets.

9. The improved wall construction of claim 1 wherein said symmetric recesses are provided with an adhesive placed therein.

10. The improved wall construction of claim 9 wherein said adhesive is comprised of polymer-based material.

11. The improved wall construction of claim 9 wherein said adhesive contains petroleum distillates.

12. The improved wall construction of claim 1 wherein said flanged stud members are made from a metal or metal alloy.

13. The improved wall construction of claim 1 wherein said flanged stud members arc made from a thermoplastic polymer-based material.

14. An improved method for constructing a wall including a plurality of rigid, self-supporting panels to divide or partition interior building space, said panels having a substantially rectangular shape with an inner and an outer face and a top edge, a bottom edge, a front edge and a rear edge, said front and rear edges having along a centerline a plurality of symmetric recesses for accepting a symmetric connector insert therein, said method comprising the steps of:

attaching a plurality of top rail members to a ceiling along the top centerline of a wall, said top rail members each having a substantially flat elongated rectangular shape with a first and second end and having a raised spine member spanning from first to second end;

attaching a plurality of bottom rail members to a floor along the bottom centerline of a wall, said bottom rail members each having a substantially flat elongated rectangular shape with a first and second end and having a raised spine member spanning from first to second end; and placing a plurality of vertically oriented flanged stud members between said top and bottom rail members such that said stud members are slidably retained between said rail members providing for lateral movement along the wall line, said flanged stud members each having a top and bottom end and a substantially hat-shaped cross section that includes a large flange and a small flange joined together by a spine channel located there between, said large flange, small flange, and spine channel each having a substantially flat outer surface with said outer surfaces in substantially parallel respective position and said large and small flanges being in planar respective position, said top and bottom ends each having a lateral slot for slidably receiving said raised spine member of said top and bottom rails therein, said lateral slot oriented substantially parallel to said small and large flange and having a tab adjacent thereto, thereby producing a frame suitable for attachment of one or more rigid, self-supporting panel; and further comprising the steps of;

placing a first panel adjacent to a first flanged stud member such that front edge of first panel is in substantially parallel position relative to said first hat channel and inner face of said first panel is in contact with and covers a portion of the outer surface of said large flange;

attaching said first panel to said first flanged stud member by means of a plurality of penetrating connectors placed through said large flange and terminating in said first panel;

placing a second panel adjacent to said first flanged stud member that front edge of second panel is in substantially parallel position relative to said first flanged stud member and inner face of said second panel is in contact with and covers a portion of the outer surface of said spine channel;

attaching said second panel to said first flanged stud member by means of a plurality of penetrating connectors placed through said spine channel and terminating in said second panel;

inserting symmetric connectors into each of a plurality of recesses located along front edge of said second panel such that substantially one half of each connector protrudes beyond said front edge of said second panel;

placing a third panel adjacent to said first flanged stud member such that rear edge of said third panel is in abutted contact with front edge of said first panel and inner face of third panel is in contact with remaining exposed outer surface of said large flange and covers the outer surface of said small flange; sliding a second flanged stud member into position so that third panel partially covers the outer surface of said large flange;

attaching said third panel to said first flanged stud by means of a plurality penetrating connectors placed through said small flange and terminating in said third panel;

attaching said third panel to said second flanged stud by means of a plurality of penetrating connectors placed through said large flange and terminating in said third panel;

placing rear edge of a fourth panel in abutted contact with front edge of said second panel such that exposed portions of symmetric connectors located along front edge of second panel are fully received into adjacent recesses located in said rear edge of said fourth panel and further positioning said fourth papel adjacent to said flanged stud member such that inner face of said fourth straw panel covers a portion of the outer surface of said spine channel; and attaching said fourth panel to said second flanged stud member by means of a plurality of penetrating connectors placed through said spine channel and terminating in said fourth panel.

15. The improved method for constructing a wall of claim 14, further comprising the step of providing said symmetric recesses with adhesive prior to inserting symmetric connectors therein.

16. The improved method of constructing a wall of claim 15, further comprising the step of securing each said flanged stud member in place by inserting a penetrating connector through each said tab and terminating said penetrating connector in said spine member of said top or bottom rail member.

* * * * *